US010190828B2

(12) United States Patent
Rhoden et al.

(10) Patent No.: US 10,190,828 B2
(45) Date of Patent: Jan. 29, 2019

(54) HEAT EXCHANGERS

(71) Applicant: Hamilton Sundstrand Corporation, Charlotte, NC (US)

(72) Inventors: William E. Rhoden, Glastonbury, CT (US); Leo J. Veilleux, Jr., Wethersfield, CT (US); Peter J. Padykula, Brimfield, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 307 days.

(21) Appl. No.: 14/920,213

(22) Filed: Oct. 22, 2015

(65) Prior Publication Data

US 2017/0115065 A1 Apr. 27, 2017

(51) Int. Cl.

| | |
|---|---|
| ***F28D 1/047*** | (2006.01) |
| ***F28F 1/04*** | (2006.01) |
| ***F28F 9/02*** | (2006.01) |
| ***F28F 13/06*** | (2006.01) |

(52) U.S. Cl.

CPC ..... *F28D 1/0475* (2013.01); *F28F 1/04* (2013.01); *F28F 9/0243* (2013.01); *F28F 13/06* (2013.01); *F28F 2230/00* (2013.01); *F28F 2275/04* (2013.01); *F28F 2275/20* (2013.01)

(58) Field of Classification Search

CPC ..... F28D 1/0475; F28F 9/0243; F28F 1/04; F28F 13/06; F28F 2230/00; F28F 2275/04; F28F 2275/20; B21D 53/06

USPC ..... 165/176

See application file for complete search history.

(56) References Cited

U.S. PATENT DOCUMENTS 1,980,811 A * 11/1934 Ljungstrom ..... F01P 3/00 123/41.46
2,269,619 A * 1/1942 Carpenter ..... F28F 9/22 165/161
2,311,190 A * 2/1943 Shaw ..... F28D 7/08 165/159
2,391,244 A * 12/1945 Jackson ..... F25J 5/002 165/135

(Continued)

FOREIGN PATENT DOCUMENTS

DE 3803599 A1 * 8/1989 ..... F28D 1/0475
DE 3803599 A1 8/1989
EP 0849557 A1 6/1998

OTHER PUBLICATIONS

Extended European Search Report issued by Examiner David Bain, of the European Patent Office, dated Feb. 28, 2017, in corresponding European Patent Application No. 16195018.3.

*Primary Examiner* — Devon Russell
(74) *Attorney, Agent, or Firm* — Locke Lord LLP; Daniel J. Fiorello

(57) ABSTRACT

A heat exchanger includes a first half defining a first inlet portion and a first outlet portion, a second half defining a second inlet portion and a second outlet portion. The first half and the second half are configured to mate and form an inlet chamber and an outlet chamber. At least one of the first half or the second half includes one or more inlet transfer holes defined through a thickness of at least one of the first inlet portion and/or the second inlet portion. At least one of the first half or the second half includes one or more outlet transfer holes defined through a thickness of at least one of the first outlet portion or the second outlet portion.

14 Claims, 2 Drawing Sheets

(56) References Cited

U.S. PATENT DOCUMENTS 2,660,411 A * 11/1953 Weber ..... F28F 9/0229 165/11.1
3,080,915 A * 3/1963 Hamill ..... F28D 7/1661 165/158
3,415,315 A * 12/1968 Donaldson ..... F28F 9/001 165/148
4,800,955 A * 1/1989 Hagemeister ..... F28D 7/06 165/163
4,893,674 A * 1/1990 Hagemeister ..... F28D 7/06 165/176
4,969,510 A * 11/1990 Greune ..... F28D 7/06 165/176
4,976,310 A * 12/1990 Jabs ..... F28D 7/06 165/145
5,596,877 A * 1/1997 Morrison ..... F28D 7/08 165/10
5,799,397 A * 9/1998 Yasuda ..... B21D 53/04 29/890.052
5,944,096 A * 8/1999 Hubert ..... F28F 9/0224 165/173
6,289,585 B1 * 9/2001 Staruszkiewicz ..... B21D 53/06 165/173
6,305,465 B1 * 10/2001 Uchikawa ..... F28D 1/0435 165/135
6,484,796 B2 * 11/2002 Demuth ..... F28D 1/0478 165/144
6,745,827 B2 * 6/2004 Lee ..... F25B 39/02 165/144
7,621,150 B2 11/2009 Kadle et al.
9,067,270 B2 6/2015 Okamoto et al.
9,593,889 B2 * 3/2017 Sundralingam ..... F28D 1/05375
2006/0048929 A1 * 3/2006 Aaron ..... F28D 7/08 165/173
2011/0186276 A1 8/2011 Casterton et al.
2011/0272128 A1 * 11/2011 Suzuki ..... F28D 1/0476 165/185
2013/0020047 A1 1/2013 Army, Jr. et al.
2013/0201628 A1 * 8/2013 Aoki ..... F28D 1/0476 361/699
2013/0213368 A1 * 8/2013 Capelle ..... F28D 7/06 123/568.12

* cited by examiner

HEAT EXCHANGERS

BACKGROUND

1. Field

The present disclosure relates to heat exchangers, more specifically to heat exchangers for high temperature environments.

2. Description of Related Art

Traditional high temperature air/air heat exchangers that operate above about 1500 F and above about 1000 psi pressure range are difficult to manufacture. Durability and life are significant concerns as thermal fatigue weakens the component material. Multiple braze/weld joints are required for traditional designs, increasing the potential for leaks over time. Further, once built, the core is essentially inaccessible for repair or inspection.

Such conventional methods and systems have generally been considered satisfactory for their intended purpose. However, there is still a need in the art for improved heat exchangers. The present disclosure provides a solution for this need.

SUMMARY

A heat exchanger includes a first half defining a first inlet portion and a first outlet portion, a second half defining a second inlet portion and a second outlet portion. The first half and the second half are configured to mate and form an inlet chamber and an outlet chamber. At least one of the first half or the second half includes one or more inlet transfer holes defined through a thickness of at least one of the first inlet portion and/or the second inlet portion. Similarly, at least one of the first half or the second half includes one or more outlet transfer holes defined through a thickness of at least one of the first outlet portion or the second outlet portion.

One or more transfer tubes includes an inlet end and an outlet end such that each transfer tube is connected to the inlet transfer holes at the inlet end thereof and each transfer tube is connected to the outlet transfer holes at the outlet end thereof. The inlet chamber and outlet chamber are fluidly isolated from each other through the first half and second half such that the inlet chamber and outlet chamber are fluidly connected to each other through the one or more transfer tubes.

Each half can further include a plurality of fastener flanges extending therefrom configured to receive a fastener to secure the first half to the second half. The heat exchanger can further include one or more of the fastener. The fastener can be a removable fastener (e.g., a bolt).

The one or more inlet transfer holes can include a plurality of inlet transfer holes and the one or more outlet transfer holes can include a plurality of outlet transfer holes. In certain embodiments, the inlet portion can include a flat inner surface. The inlet end of each transfer tube can be brazed to the one or more inlet transfer holes at the flat inner surface of the inlet portion. Each transfer tube can be a unified part of inlet utilizing additive manufacturing methods. In certain embodiments, an outer shroud guides the cooling air over the transfer tubes.

In certain embodiments, the outlet portion can include a flat inner surface. The outlet end of each transfer tube can be brazed to the one or more outlet transfer holes at the flat inner surface of the outlet portion. In certain embodiments, the inlet portion and/or the outlet portion include rectangular cross-sectional shapes defining the inlet chamber and/or outlet chamber, respectively.

The first half and second half include double semicircular halves, however, any other suitable outer shape is contemplated herein. In certain embodiments, the heat exchanger can further include a seal in between inlet chamber and the outlet chamber within the first half and the second half to fluidly isolate the inlet chamber and the outlet chamber.

A method includes forming a heat exchanger to include an inlet portion and an outlet portion, at least one of the inlet portion and the outlet portion including a flat inner surface, and brazing at least one transfer tube disposed in a transfer hole of the inlet portion and the outlet portion to the flat inner surface.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
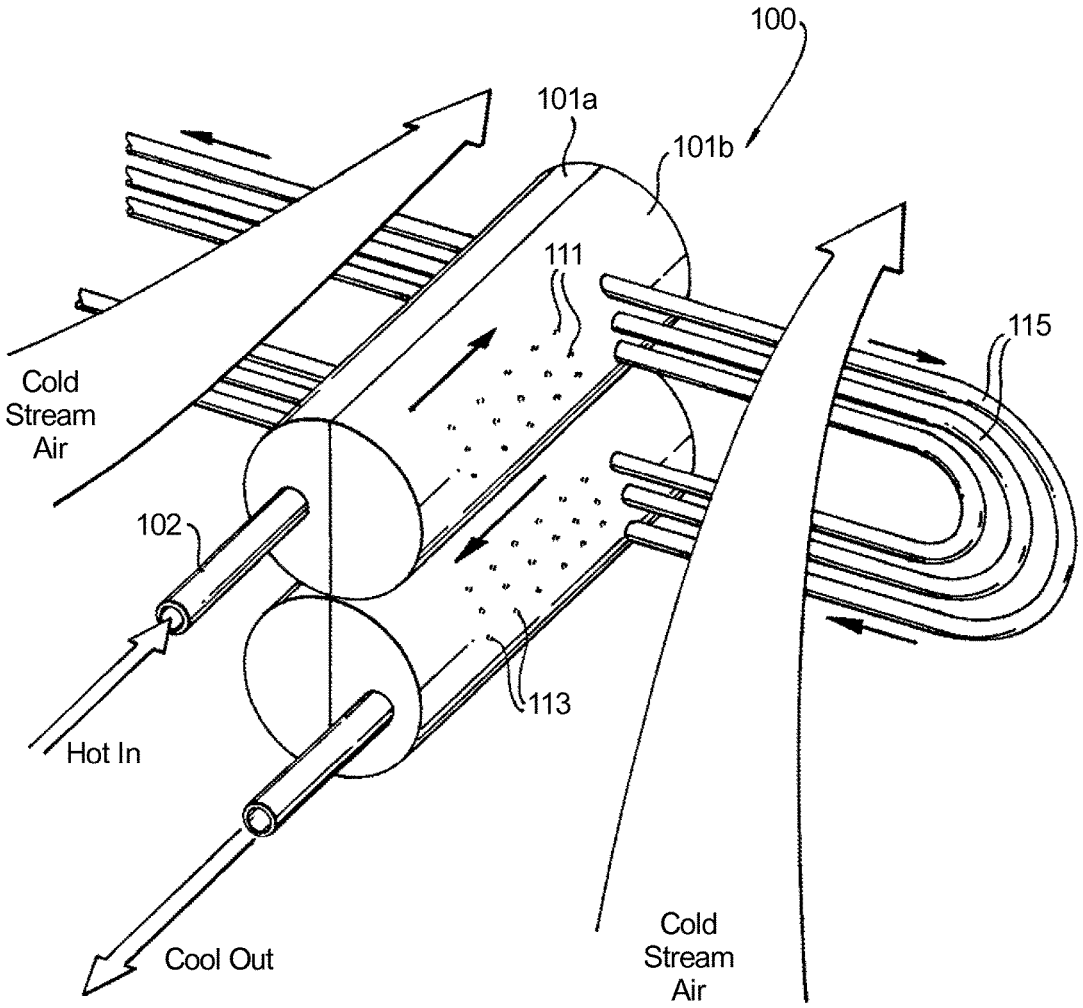
FIG. 1 is a partial perspective view of an embodiment of a heat exchanger in accordance with this disclosure.
Figure 2:
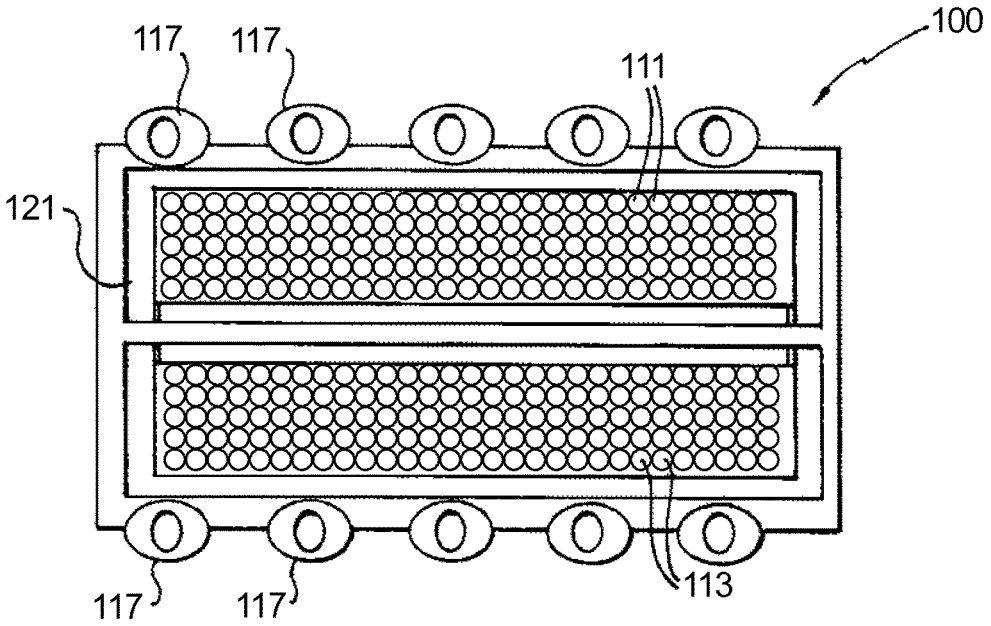
FIG. 2 is a cross-sectional view of the heat exchanger of FIG. 1.
Figure 3:
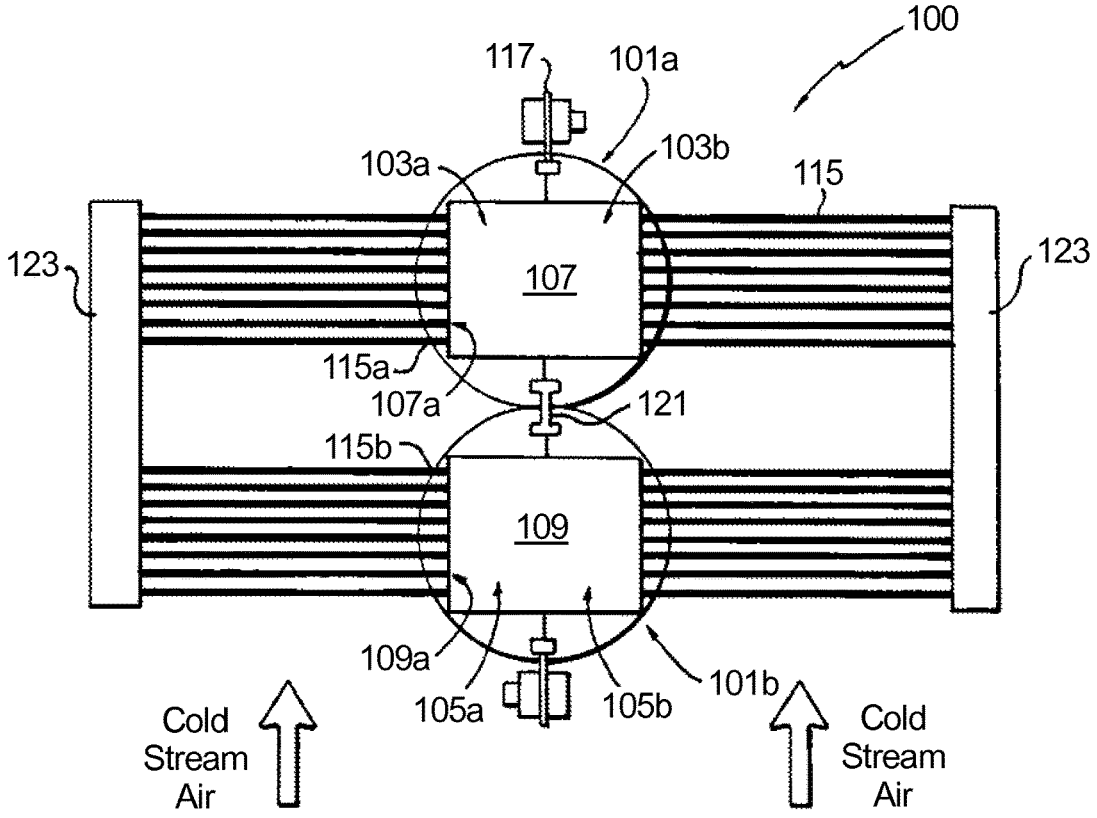
FIG. 3 is a cross-sectional side view of the heat exchanger of FIG. 1.

Reference will now be made to the drawings wherein like reference numerals identify similar structural features or aspects of the subject disclosure. For purposes of explanation and illustration, and not limitation, an illustrative view of an embodiment of a heat exchanger in accordance with the disclosure is shown in FIG. 1 and is designated generally by reference character 100. Other embodiments and/or aspects of this disclosure are shown in FIGS. 2 and 3. The systems and methods described herein can be used to provide improved high temperature and pressure heat exchangers.

Referring to FIGS. 1-3, a heat exchanger 100 includes a first half 101*a* defining a first inlet portion 103*a* and a first outlet portion 105*a*, and a second half 101*b* defining a second inlet portion 103*b* and a second outlet portion 105*b*. The first half 101*a* and the second half 101*b* are configured to mate and form an inlet chamber 107 (formed by outlet portions 103*a*, 103*b*) and an outlet chamber 109 (formed by outlet portions 105*a*, 105*b*). As shown, one end of the heat exchanger 100 can be sealed while the other end features an inlet 102 and outlet 104.

In certain embodiments, the inlet and outlet ports can be on the first half 101*a* side of the inlet and/or on the second half 101*b* side of the inlet or can have inlet openings on both sides. Any other suitable inlet/outlet configuration is contemplated herein.

At least one of the first half 101*a* or the second half 101*b* includes one or more inlet transfer holes 111 defined through a thickness of at least one of the first inlet portion 103*a* and/or the second inlet portion 103*b*. Similarly, at least one of the first half 101*a* or the second half 101*b* includes one or more outlet transfer holes 113 defined through a thickness of at least one of the first outlet portion 105*a* and/or the second outlet portion 105*b*. The transfer holes 111, 113 can be drilled out and have dimensions slightly larger than a transfer tube 115 as described below.

The heat exchanger 100 can include one or more transfer tubes 115 includes an inlet end 115*a* and an outlet 115*b* end such that each transfer tube 115 is connected to the inlet transfer holes 111 at the inlet end 115*a* thereof and each transfer tube 115 is connected to the outlet transfer holes 113 at the outlet end thereof 115*b*. Transfer tubes 115 can be swaged and/or brazed in place, however, any other suitable attachment method is contemplated herein. Alternatively, the transfer tubes 115 can be manufactured as an integral single piece to the first half 101*a* and/or the second half 101*b* utilizing additive manufacturing methods. A transfer header 123 can be included to segment the transfer tubes 115 and reduce space taken up by bending the transfer tubes 115 instead. The inlet chamber 107 and outlet chamber 109 are fluidly isolated from each other through the first half 101*a* and second half 101*b*, but are fluidly connected to each other through the one or more transfer tubes 115.

Each half 101*a*, 101*b* can further include a plurality of fastener flanges 117 extending therefrom and configured to receive a fastener 119 to secure the first half 101*a* to the second half 101*b*. The heat exchanger 100 can further include one or more fasteners 119. The fastener 119 can be a removable fastener (e.g., a bolt) or any other suitable fastener/combination thereof. The fasteners 119 can be selected to have expansion characteristics compatible with the heat exchanger 100 material. Unbolting the two halves 101, 103 can allow access to the interior of the heat exchanger 100.

In certain embodiments, the inlet portion 107 can include a flat inner surface 107*a*. The inlet end 115*a* of each transfer tube 115 can be brazed to the one or more inlet transfer holes 111 at the flat inner surface 107*a* of the inlet portion 107. The outlet portion 109 can additionally or alternatively include a flat inner surface 109*b*. Similarly, the outlet end 115*b* of each transfer tube 115 can be brazed to the one or more outlet transfer holes 113 at the flat inner surface 109*a* of the outlet portion 109. In certain embodiments, the heat exchanger 100 can include flat inner surfaces 107*a*, 109*a* on at least two sides of each chamber 107, 109.

As shown, in certain embodiments, the inlet portion 107 and/or the outlet portion 109 can include rectangular cross-sectional shapes defining the inlet chamber 107 and/or outlet chamber 109, respectively. Any other suitable shape is contemplated herein.

The first half 101*a* and second half 101*b* can include double semicircular halves as shown. Any other suitable outer shape of the first half 101*a* and/or the second half 101*b* is contemplated herein. In certain embodiments, the heat exchanger 100 can further include at least one seal 121 in between inlet chamber 107 and the outlet chamber 109 within the first half 101*a* and the second half 101*b* to fluidly isolate the inlet chamber 107 and the outlet chamber 109. The seal 121 can include a high temperature metal or any other suitable material.

In accordance with at least one aspect of this disclosure, a method can include forming a heat exchanger 100 to include an inlet portion and an outlet portion, at least one of the inlet portion and the outlet portion including a flat inner surface 107*a*, 109*a*. The method can also include brazing at least one transfer tube 115 disposed in a transfer hole 111, 113 of the inlet portion and the outlet portion to the flat inner surface 107*a*, 109*a*.

As shown, a two-piece heat exchanger 100 can resemble a standard pressure vessel from the exterior. A first fluid referred to as the hot fluid or gas, and second fluid or gas referred to as the cold fluid provide heat transfer with the heat exchanger described. Embodiments as described herein include fewer joints and improved assembly. As a result, embodiments of this disclosure have improved high temperature and pressure performance.

The methods and systems of the present disclosure, as described above and shown in the drawings, provide for heat exchangers with superior properties including high temperature and pressure serviceability. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A heat exchanger, comprising:

a first half defining a first inlet portion and a first outlet portion;

a second half defining a second inlet portion and a second outlet portion, wherein the first half and the second half are configured to mate and form an inlet chamber and an outlet chamber, wherein at least one of the first half or the second half includes one or more inlet transfer holes defined through a thickness of at least one of the first inlet portion and/or the second inlet portion, wherein at least one of the first half or the second half includes one or more outlet transfer holes defined through a thickness of at least one of the first outlet portion or the second outlet portion;

one or more transfer tubes including an inlet end and an outlet end, wherein each transfer tube is connected to the one or more inlet transfer holes at the inlet end thereof, wherein each transfer tube is connected to the one or more outlet transfer holes at the outlet end thereof, wherein the inlet chamber and outlet chamber are fluidly isolated from each other such that fluid cannot pass between first half and second half such that the inlet chamber and outlet chamber are only fluidly connected to each other through the one or more transfer tubes, wherein each half further comprises a plurality of fastener flanges extending therefrom configured to receive a fastener to secure the first half to the second half, wherein the first half and second half include double semicircular halves.

2. The heat exchanger of claim 1, further comprising the fastener.

3. The heat exchanger of claim 2, wherein the fastener is a removable fastener.

4. The heat exchanger of claim 3, wherein the fastener is a bolt.

5. The heat exchanger of claim 1, wherein the one or more inlet transfer holes includes a plurality of inlet transfer holes.

6. The heat exchanger of claim 1, wherein the one or more outlet transfer holes includes a plurality of outlet transfer holes.

7. The heat exchanger of claim 1, wherein the inlet portion includes a flat inner surface.

8. The heat exchanger of claim 7, wherein the inlet end of each transfer tube is brazed to the one or more inlet transfer holes at the flat inner surface of the inlet portion.

9. The heat exchanger of claim 1, wherein the outlet portion includes a flat inner surface.

10. The heat exchanger of claim 9, wherein the outlet end of each transfer tube is brazed to the one or more outlet transfer holes at the flat inner surface of the outlet portion.

11. The heat exchanger of claim 1, wherein the inlet portion and/or the outlet portion include rectangular cross-sectional shapes defining the inlet chamber and/or outlet chamber, respectively.

12. The heat exchanger of claim 1, comprising a seal in between the inlet chamber and the outlet chamber within the first half and the second half to fluidly isolate the inlet chamber and the outlet chamber.

13. The heat exchanger of claim 7, wherein each transfer tube is a unified part of inlet utilizing additive manufacturing methods.

14. The heat exchanger of claim 1, wherein an outer shroud guides the cooling air over the transfer tubes.

* * * * *